US008914917B1

(12) United States Patent
Huntsman et al.

(10) Patent No.: US 8,914,917 B1
(45) Date of Patent: Dec. 23, 2014

(54) UNIVERSAL ATHLETIC PADS WITH COMBINATION ATTACHMENT MEANS

(75) Inventors: Ryan Huntsman, Houston, TX (US); Kevin Bull, Houston, TX (US); Jeff Douglas, Houston, TX (US)

(73) Assignee: Douglas Pads Sports, Inc., Houston, TX (US)

( * ) Notice: Subject to any disclaimer, the term of this patent is extended or adjusted under 35 U.S.C. 154(b) by 568 days.

(21) Appl. No.: 13/026,267

(22) Filed: Feb. 13, 2011

(51) Int. Cl.
*A41D 13/00* (2006.01)

(52) U.S. Cl.
USPC ..... 2/465; 2/22; 2/267

(58) Field of Classification Search
USPC ..... 2/22, 23, 455, 464, 465, 267, 338, 336
See application file for complete search history.

(56) References Cited

U.S. PATENT DOCUMENTS

| | | | | | |
|---|---|---|---|---|---|
| 1,044,494 | A | * | 11/1912 | Clarke | 2/23 |
| 1,857,850 | A | * | 5/1932 | Jones | 2/23 |
| 2,889,830 | A | * | 6/1959 | Raymond | 450/98 |
| 3,044,075 | A | * | 7/1962 | Rawlings | 2/22 |
| 3,484,868 | A | * | 12/1969 | Davenport, Jr. | 2/465 |
| 4,151,613 | A | | 5/1979 | Rhee | |
| 4,317,237 | A | * | 3/1982 | Porte | 2/464 |
| 4,688,269 | A | * | 8/1987 | Maeshima | 2/456 |
| D301,566 | S | * | 6/1989 | Heiberger | D11/218 |
| 5,259,096 | A | * | 11/1993 | Grant | 24/324 |
| 5,405,312 | A | | 4/1995 | Jacobs | |
| 5,557,804 | A | * | 9/1996 | Ovortrup et al. | 2/23 |
| 5,852,829 | A | * | 12/1998 | Relaford | 2/338 |
| 5,983,407 | A | | 11/1999 | McKay | |
| 6,009,565 | A | * | 1/2000 | Carrington | 2/455 |
| 6,327,715 | B1 | * | 12/2001 | Castiglione | 2/267 |
| 6,745,406 | B2 | * | 6/2004 | Ruane | 2/465 |
| 6,854,129 | B2 | * | 2/2005 | Mazzarolo | 2/23 |
| 7,487,557 | B2 | * | 2/2009 | Bellfy | 2/465 |
| 7,891,026 | B1 | * | 2/2011 | Smith | 2/465 |
| 8,272,073 | B2 | * | 9/2012 | Arensdorf et al. | 2/267 |

* cited by examiner

*Primary Examiner* — Richale Quinn
(74) *Attorney, Agent, or Firm* — Kenneth A. Roddy

(57) ABSTRACT

Protective hip pads and tailbone pads formed of resilient padding material have a combination belt slot and snap faster attachment arrangement and can selectively attached to athletic pants having either snap fasteners in the waistband, or to athletic pants having a waistband with a number of exposed slots through which a belt extends. Thin stiff flexible support plates are affixed to the front and back side of the pads and laterally spaced slotted apertures extending through the pad and support plates have a vertical slot and an intersecting horizontal slot. Snap fasteners slidably mounted in respective horizontal slots can be moved to be aligned and pressed onto mating snap members in the waistband to secure the pads to the waistband or, alternatively, moved to expose the vertical slots to receive a pants belt laced through the waistband and vertical slots to secure the pads to the waistband.

16 Claims, 4 Drawing Sheets

UNIVERSAL ATHLETIC PADS WITH COMBINATION ATTACHMENT MEANS

BACKGROUND OF THE INVENTION

1. Field of the Invention

This invention relates generally to protective pads of the type worn by athletes, and more particularly to protective hip pads and tailbone pads that have a combination belt slot and snap faster attachment arrangement that allow them to be selectively attached to athletic pants having either snap fasteners in the waistband, or to athletic pants having a waistband with a number of exposed slots through which a belt extends.

2. Background Art

Protective athletic pads, such as hip pads and tailbone pads are commonly employed to protect athletes and persons participating in other sports activities from bruises or more serious injury. Conventional commercially available hip pads and tailbone pads of the type worn by football players are provided only as two types; either a "snap-in" type pad or as a "slotted" pad. The "snap-in" type pad is provided with a pair of laterally spaced of snap fasteners at an upper portion thereof. The "slotted" type pad is provided with one or more pairs of laterally spaced vertical belt slots at an upper portion thereof. Conventional commercially available football uniform pants are also provided only as two types; either a "snap-in" type, which has snap fasteners in the waistband, or a "slotted" type which has a waistband with a number of exposed slots through which a belt extends.

The hip pads and tailbone pads are typically inserted into pockets in an elastic tight-fitting undergarment known as a "corset" or "girdle", or into pockets in the outer uniform pants, such that the attachment elements (either snap fasteners or belt slots) are exposed. Conventional commercially available athletic football uniform pants are also provided only as two types; either a "snap-in" type, which has snap fasteners in the waistband, or a "slotted" type which has a waistband with a number of exposed belt slots through which a belt extends.

The upper portion of the "snap-in" type hip and tailbone pads are secured to the "snap-in" type pants by engaging the snap fasteners of the hip pads and tailbone pad with mating snap fasteners on the waistband. The upper portion of the "slotted" type hip and tailbone pads are secured to the "slotted" type pants by lining up the belt slots of the pads with the belt slots on the waistband and lacing the belt through the pants, and the belt slots of the pads.

One of the problems with the conventional "snap-in" and "slotted" type hip and tailbone pads is that they are not interchangeable. In other words, "snap-in" pads cannot be used with "slotted" type athletic uniform pants, and "slotted" pads cannot be used with "snap-in" type athletic uniform pants.

There are several patent that are directed toward athletic pads of various construction that are connectable to athletic pants or to the wearer by snap fasteners, straps, belts, and various other means.

Jones, U.S. Pat. No. 1,557,550 discloses a pant body having a waist guard member extending upwardly from the waist portion thereof and surrounding the waist portion of the wearer's body. A pelvic guard member is laced at its upper edge and upper forward edge to the outside of the waist guard member and depends therefrom so as to be free to swing relative to the pant body.

Davenport, Jr., U.S. Pat. No. 3,484,868 discloses an athletic pad of the snap fastener type which is connectable to either elastic or inelastic athletic uniform trousers. The pad has a retaining plate attached to one side with slots in the retaining plate in which male snap connectors are slidably mounted that are connectable to female connector members on an elastic portion of an athletic uniform so that stretching of the elastic portion is enabled by sliding movement of the male connectors in their support slots.

Rhee, U.S. Pat. No. 4,151,613 discloses a protective device adapted to protect the buttocks and hips of a person engaging in the sport of skateboarding. The device is constructed from a resilient material, such as plastic foam which may be covered with a tough, pliable plastic material or the like, and comprises a generally rectangular member having two cutout portions in the upper part and three arm members, through each of which a belt member is passed and the lower portion of the device comprises a pair of double stranded cord members. The device is secured around the waist by the belt member, and the cord members passing around the legs to retain the lower portion of the device on the wearer.

Jacobs, U.S. Pat. No. 5,405,312 discloses a custom fit body part guard or shield which includes a thin shell formed from an ionomer resin which has a softening temperature within the range of 60°-80° C. The shell material of approximately 1-6 millimeters thickness is partially molded to fit the area of the body where the device is intended to be used. A layer of perforated foam material can be adhered to the inside surface of the guard to further protect the user's skin and absorb or distribute impact energy during use. The guard can be softened to a moldable consistence by holding it under ordinary hot tap water. By firmly applying and holding it on the surface of the area of the body where it is intended to be used and allowing the guard to cool to ambient temperature the guard will take a permanent set to a custom shape which follows the exact shape and contour of the body part. The device can be arranged to protect passive areas of the body, such as the shin or forearms or can be used to protect body joints, such as elbows or knees.

McKay, U.S. Pat. No. 5,983,407 discloses a coccygeal protective pad worn under the trousers, hooked to the trousers or belt, for protecting skaters from spinal injury when falling. The pad has a substantially rigid central flat panel curved at the bottom to conform to the human form and a hook at the top for clipping to the trousers. A foamed synthetic resin member covers the front of the central panel and a high density foamed synthetic resin member covers the rear. The central panel and foamed members are encased in a fabric sheath. The hook protrudes through the fabric sheath. The central panel and front and rear foamed members are perforated by ventilation holes. A gel filled cushion provides additional shock absorbency.

SUMMARY OF THE INVENTION

The present invention overcomes the aforementioned problems and is distinguished over the prior art in general, and these patents in particular by protective hip pads and tailbone pads that have a combination belt slot and snap faster attachment arrangement that allows them to be selectively attached to athletic pants having either snap fasteners in the waistband, or to athletic pants having a waistband with a number of exposed slots through which a belt extends. The hip pads and tailbone pad, each have thin support plates formed of a stiff flexible material affixed to their front side and back side. Laterally spaced slotted apertures extend through the pad and support plates and have a vertical slot and an intersecting horizontal slot. A snap fastener member is slidably mounted in a respective horizontal slot and is movable therein relative to the vertical slot. In a first attachment position, the snap fasteners are moved to become aligned with mating snap members in the waistband of the pants, and pressed thereon to engage the snap fasteners with the mating fasteners of the waistband and secure the pads to the waistband of the pants. In a second attachment position, the snap fasteners are moved to expose the vertical slots to be aligned with the exposed belt slots of the waistband of the pants to allow lacing of the pants belt through the vertical slots of the pads and secure the pads to the waistband of the pants.

One of the significant features and advantages of the present invention is that it provides universal athletic protective hip pads and tailbone pads that can be easily and quickly attached to the waistband of either "snap-in" or "slotted" athletic pants, and therefore eliminates the necessity of having dedicated pads for each type of pants.

Another significant feature and advantage of the present invention is that the universal athletic protective hip pads have a generally elliptical mid portion to cover and protect the iliac crest of the wearer's pelvis, a rectangular upper portion extending above the mid portion to protect the area of the wearer's body above the iliac crest, and a generally elliptical lower portion to cover and protect the greater trochanter of the wearer's femur, and are sufficiently flexible to curve along their longitudinal axis and generally conform to the covered body areas.

Another significant feature and advantage of the present invention is that the universal athletic protective tailbone pads have a generally rectangular configuration with a wider upper portion which converges downwardly and adjoins a contiguous lower portion of a narrower width to cover and protect the coccyx area of the wearer, and are sufficiently flexible so as curve along their length to generally conform to the coccyx area.

Another significant feature and advantage of the present invention is that the universal athletic protective hip pads and tailbone pads are simple in construction, inexpensive to manufacture, and rugged and safe in use.

Other features and advantages of the invention will become apparent from time to time throughout the specification and claims as hereinafter related.

DESCRIPTION OF THE PREFERRED EMBODIMENT

Figure 1:
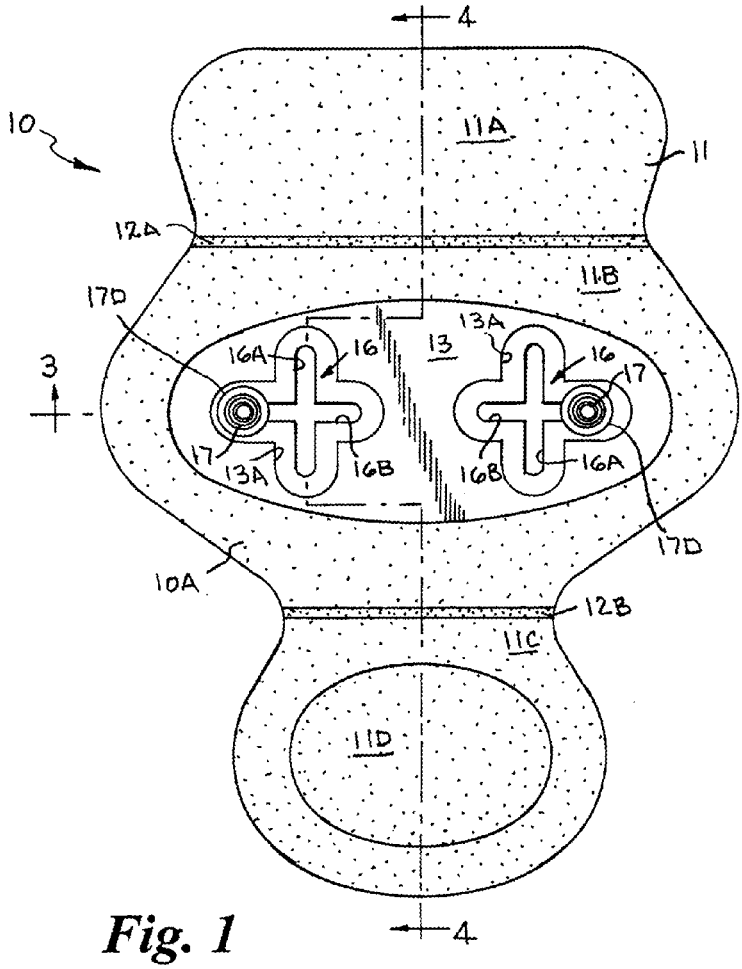
FIG. 1 is an elevation view of the front side of a protective athletic hip pad in accordance with the present invention.

In the following discussion, the terms "front", "front side", and "front surface" refer to the surface of the pad that faces outwardly from a wearer's body; and the terms "back", "back side", and "back surface" refer to the surface of the pad that faces toward a wearer's body. Although only one hip pad is shown and described in detail, it should be understood that the present hip pads would be provided in pairs. It should also be understood that the present tailbone pad may be provided along with a pair of the hip pads as a hip pad set.

Referring to the drawings by numerals of reference, there is shown in FIGS. 1-4, a preferred athletic hip pad 10 in accordance with the present invention. The hip pad 10 includes a resilient pad 11 formed of a suitable flexible soft padding material, preferably closed cell EVA foam (ethylene vinyl acetate), or other conventional resilient padding material such as foam rubber, foamed vinyl or other suitable material selected from any one of many conventional compositions. The padding material may also be vinyl dipped or otherwise provided with a protective outer coating for protecting the pad from moisture, dirt or other environmental materials.

In the exemplary embodiment, but not limited thereto, the pad 11 is integrally molded and has a somewhat conventional hip pad configuration with a flat generally rectangular upper portion 11A with rounded top corners, a contiguous generally elliptical mid portion 11B adjoined at the lower end of the upper portion which is of greater width than the rectangular upper portion, and a contiguous generally elliptical lower portion 11C adjoined at the lower end of the mid portion which is of smaller width than the mid portion. The front surface 10A of the generally elliptical lower portion 11C may be provided with a smaller generally elliptical raised surface 11D to increase the thickness of the lower portion.

As with a conventional hip pad, the generally elliptical mid portion 11B is sized to cover and protect the iliac crest of the wearer's pelvis, the rectangular upper portion 11A extends above the mid portion to protect the area of the wearer's body above the iliac crest, and the generally elliptical lower portion 11C is sized to cover and protect the greater trochanter of the wearer's femur. The present hip pad 10 is sufficiently flexible so as curve along its longitudinal axis to generally conform to the body areas.

The pad 11 may be provided with a first recessed transverse groove 12A at the juncture of the generally rectangular upper portion 11A and generally elliptical mid portion 11B, and a second recessed transverse groove 12B at the juncture of the generally elliptical lower portion 11C and the lower end of the mid portion. The transverse grooves 12A and 12B allow the upper portion 11A, mid portion 11B, and lower portion 11C to flex relative to one another and to facilitate the ability of the pad 11 to conform to the body areas. It should be understood that, the particular shape of the hip pad described above is presented for purposes of example only, and may be provided in other configurations.

A thin generally elliptical support plate 13 is affixed to the front surface 10A of the mid portion 11B of the pad 11, and a pair of thin disk-shaped support plates 14 are affixed to the back surface 10B of the mid portion 11B of the pad in laterally spaced relation in a generally rectangular recessed area 15. The support plates 13 and 14 are formed of a stiff but flexible plastic material having a relatively smooth slick surface finish. The support plates 13 and 14 may be affixed to the pad 11 during the molding operation, or may be affixed to the pad by a suitable adhesive or other means conventional in the art. It should be understood that the support plates 13 and 14 may be provided in other configurations, rather than disk-shaped; for example, the support plates 13 and 14 may have a generally rectangular configuration.

A generally cross-shaped slotted aperture 16 is formed through the pad 11, the affixed support plate 16, and each of the affixed support plates 14. Each cross-shaped slotted aperture 16 has a vertical slot 16A and an intersecting horizontal slot 16B perpendicular thereto. The vertical slots 16A define a pair of laterally spaced vertical belt slots through which a belt may be passed.

A male snap fastener member 17 is slidably mounted in the horizontal slot 16B of each cross-shaped slotted aperture 16 so as to slide therein from one end of the horizontal slot to the other so as to leave the vertical slot 16A uncovered.

Figure 4:
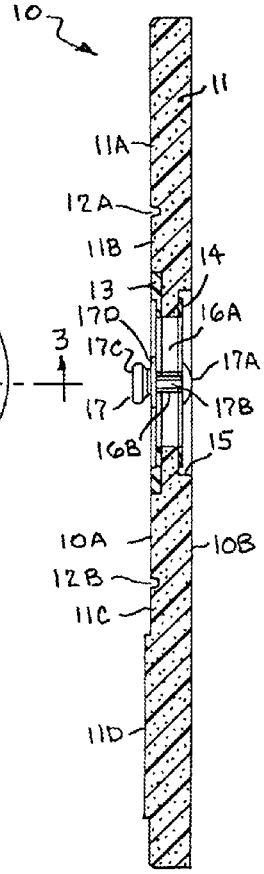
FIG. 4 is a longitudinal cross sectional view taken along line 4-4 of the hip pad of FIG. 1.
Figure 3:
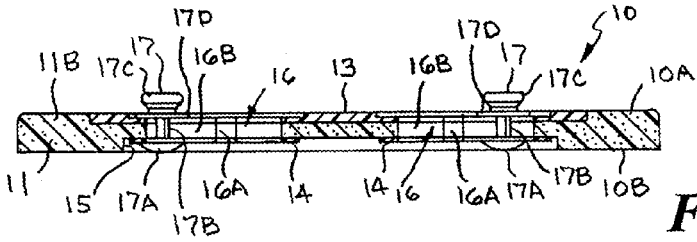
FIG. 3 is a transverse cross sectional view taken along line 3-3 of the hip pad of FIG. 1.
Figure 2:
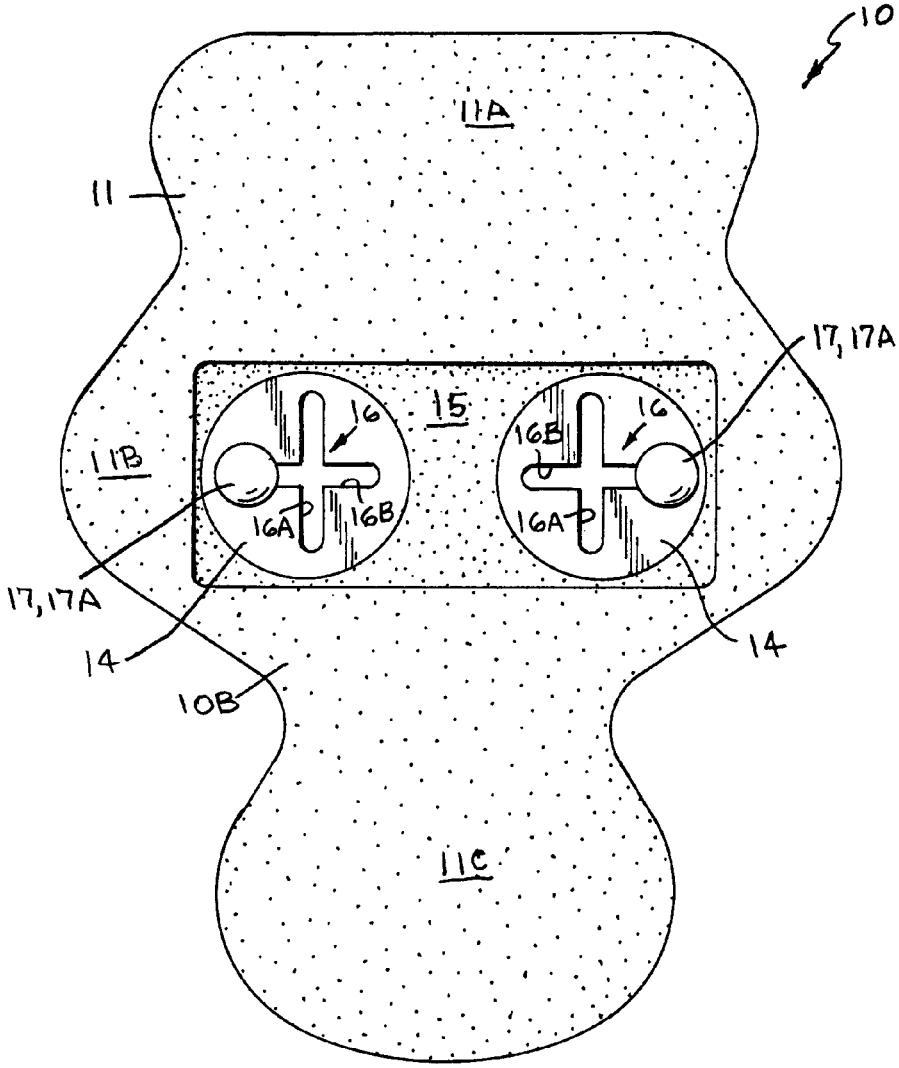
FIG. 2 is an elevation view of the back side of the hip pad of FIG. 1.
Figure 5:
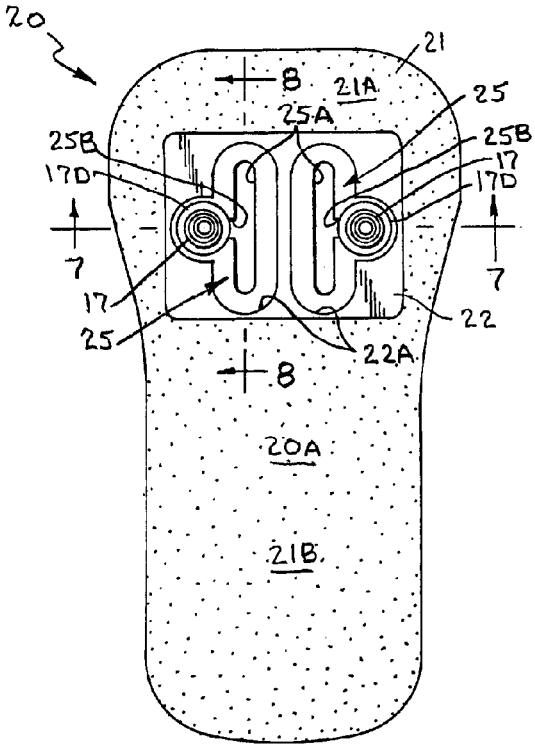
FIG. 5 is an elevation view of the front side of a protective athletic tailbone pad in accordance with the present invention.
Figure 6:
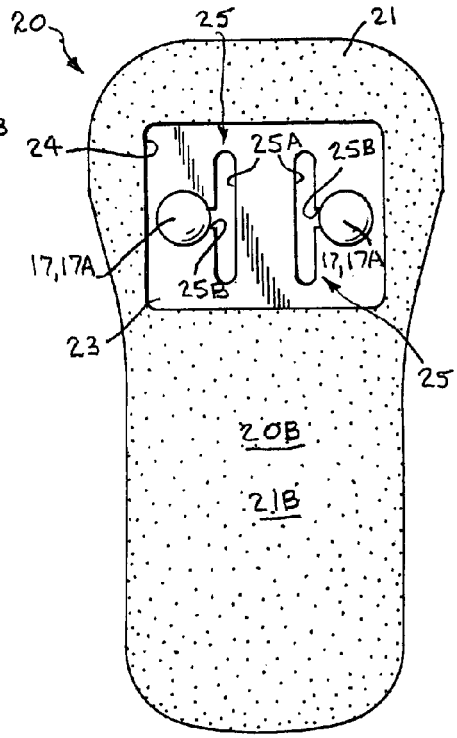
FIG. 6 is an elevation view of the back side of the tailbone pad of FIG. 5.

As best seen in FIGS. 3 and 4, each male snap fastener member 17 has an end cap 17A disposed on the back side of the slotted aperture 16, a neck portion 17B extending through the aperture and a stud 17C secured to the neck portion having a base flange 17D disposed on the front side of the aperture. The base flange 17D of the fastener may be disposed in a shallow recess 13A provided in the support plate 13. The diameter of the a neck portion 17B extending through the aperture 16 is smaller in diameter than the width of the vertical and horizontal slots 16A and 16B to allow sliding movement, and the end cap 17A and base flange 17D of the stud 17C is larger than the width of the vertical and horizontal slots to prevent the male snap fastener 17 from being removed. The end cap 17A of each male snap fastener 17 is disposed in the generally rectangular recessed area 15 on the back side 10B of the pad 11 and is preferably of a height so as not to extend above the recess.

By providing the thin generally elliptical support plate 13 on the front surface 10A of the pad 11 and a pair of laterally spaced support plates 14 on the back surface 10B of the pad, the stiffness of the support plates does not adversely affect the ability of the pad 11 to flex in a curve about its longitudinal axis to generally conform to the body areas covered by the pad.

Referring now to FIGS. 5-8, there is shown a preferred athletic tailbone pad 20 in accordance with the present invention. In the following discussion, the components which are the same as previously described are assigned the same numerals of reference, but may not be described again in detail to avoid repetition.

The tailbone pad 20 includes a resilient pad 21 which is also formed of a suitable flexible soft padding material, preferably closed cell EVA foam (ethylene vinyl acetate), or other conventional resilient padding material such as foam rubber, foamed vinyl or other suitable material selected from any one of many conventional compositions. The padding material may also be vinyl dipped or otherwise provided with a protective outer coating for protecting the pad from moisture, dirt or other environmental materials.

In the exemplary embodiment the pad 21 is integrally molded and has a somewhat conventional generally flat rectangular tailbone pad configuration with a wider upper portion 21A which converges downwardly and adjoins a contiguous lower portion 21B of a narrower width, and the corners of the pad are rounded. As with a conventional hip pad, the tailbone pad 20 is sized to cover and protect the coccyx area of the wearer, and is sufficiently flexible so as curve along its longitudinal axis to generally conform to the coccyx area.

A first thin generally rectangular support plate 22 is affixed to the front surface 20A of the upper portion 21A of the pad 21, and a second thin generally rectangular support plate 23 is affixed to the back surface 20B of the upper portion of the pad in a generally rectangular recessed area 24. The support plates 22 and 23 are formed of a stiff but flexible plastic material having a relatively smooth slick surface finish. The support plates 22 and 23 may be affixed to the pad 21 during the molding operation, or may be affixed to the pad by a suitable adhesive or other means conventional in the art. It should be understood that the support plates 22 and 23 may be provided in other configurations, rather than rectangular; for example, the support plates 22 and 23 may have a generally oval or circular configuration.

A pair of slotted apertures 25 are formed through the pad 21 and the affixed support plates 22 and 23. Each slotted aperture 25 has a vertical slot 25A and an intersecting horizontal slot 25B extending perpendicularly outward from the center thereof. The horizontal slots 25B extend outwardly from the vertical slots 25A in laterally opposed relation. The vertical slots 25A define a pair of laterally spaced vertical belt slots through which a belt may be passed.

A male snap fastener member 17 is slidably mounted in the horizontal slot 25B of each slotted aperture 25 so as to slide therein from the vertical slot 25A to the outer end of the horizontal slot 25B so as to leave the vertical slot uncovered.

Figure 7:
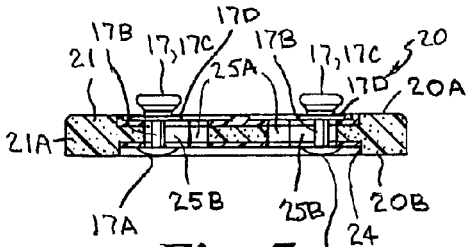
FIG. 7 is a transverse cross sectional view taken along line 7-7 of the tailbone pad of FIG. 5.
Figure 8:
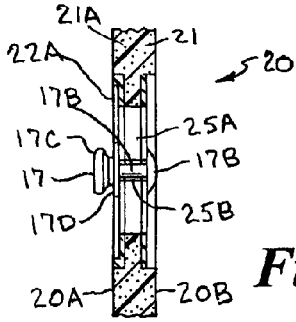
FIG. 8 is a longitudinal cross sectional view taken along line 8-8 of the tailbone pad of FIG. 5.

As best seen in FIGS. 7 and 8, each male snap fastener member 17 has an end cap 17A disposed on the back side of the slotted aperture 25 and support plate 23, a neck portion 17B extending through the aperture and a stud 17C secured to the neck portion having a base flange 17D disposed on the front side of the aperture and support plate 22. The base flange 17D of the fastener 17 may be disposed in a shallow recess 22A provided in the support plate 22. The diameter of the a neck portion 17B extending through the aperture 25 is smaller in diameter than the width of the vertical and horizontal slots 25A and 25B to allow sliding movement, and the end cap 17A and base flange 17D of the stud 17C is larger than the width of the vertical and horizontal slots to prevent the male snap fastener from being removed. The end cap 17A of each male snap fastener 17 is disposed in the generally rectangular recessed area 24.*on* the back side 20B of the pad 21 and is preferably of a height so as not to extend above the recess.

Installation

It should be understood from the foregoing, that the slotted aperture and slidable male snap fastener attachment arrangement of the present protective hip pads 10 and tailbone pads 20 allow them to be selectively attached to athletic pants having either snap fasteners in the waistband, or to athletic pants having a waistband with a number of exposed slots through which a belt extends. Typically, two hip pads 10 and a tailbone pad 20 are provided as a hip pad set.

Prior to attaching the hip pads 10 and tailbone pad 20 to the athletic pants, the hip pads and tailbone pad may be inserted into pockets in a conventional elastic tight-fitting undergarment known as a girdle, or into pockets in the outer athletic pants, such that the snap fasteners 17 and their slotted apertures 16 and 25 are exposed.

Figure 9:
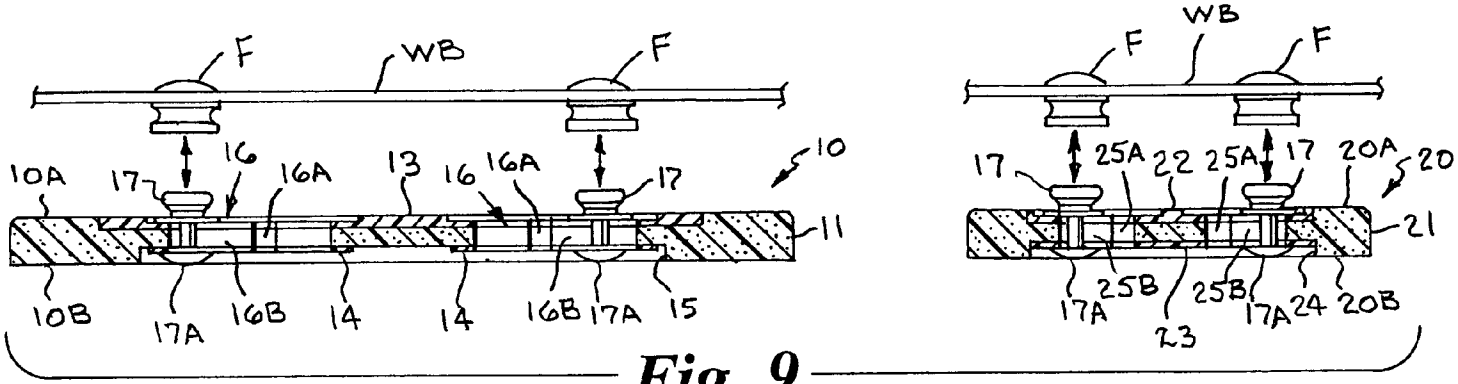
FIG. 9 is a transverse cross sectional view of a hip pad and tailbone pad, showing the snap connection to the waistband of a pair of athletic pants.

As illustrated somewhat schematically in FIG. 9, if the athletic pants are of the "snap-in" type having snap fasteners F in the waistband WB of the pants, the snap fasteners 17 of the hip pads 10 and tailbone pad 20 may be moved laterally in the horizontal slots 16B and 25B so as to become aligned with the mating snap fastener members F in the waistband, and pressed thereon to engage the fasteners and secure the pads to the waistband of the pants.

Figure 10:
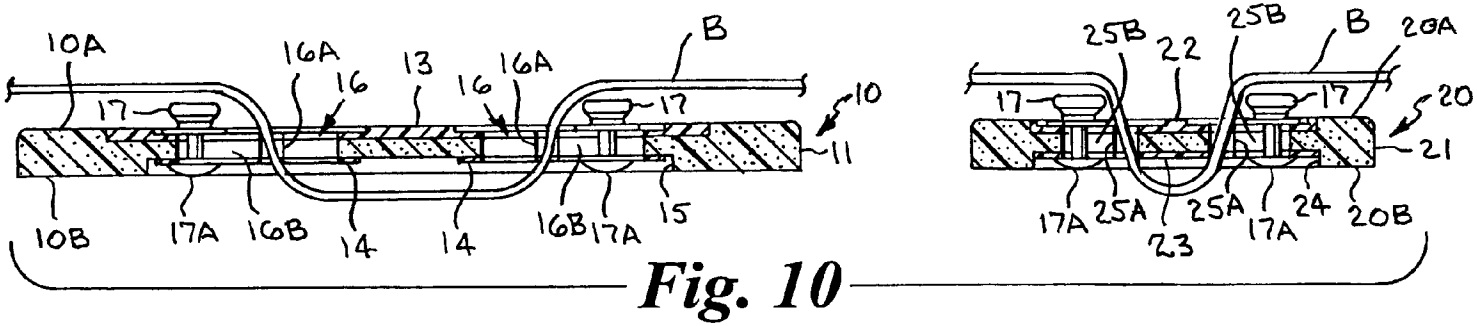
FIG. 10 is a transverse cross sectional view of a hip pad and tailbone pad, showing a pants belt laced through the vertical slots of the pads.

As illustrated somewhat schematically in FIG. 10, if the athletic pants are of the "slotted" type having a number of exposed belt slots in the waistband through which a belt B extends, the snap fasteners 17 of the hip pads 10 and tailbone pad 20 may be moved laterally in the horizontal slots 16B and 25B so as to expose the vertical slots 16A and 25A of the pads, lining up the vertical slots of the pads with the belt slots on the waistband and lacing the belt B through the pants and the vertical belt slots 16A and 25A of the pads.

Although particularly suited for use with conventional football pants, it should be understood that the present protective athletic pads may be used with various other "snap-in" or "slotted" type pants having exposed slots through which a belt extends that are worn in other sports activities, such as for example hockey, and skateboarding.

While the present invention has been disclosed in various preferred forms, the specific embodiments thereof as disclosed and illustrated herein are considered as illustrative only of the principles of the invention and are not to be considered in a limiting sense in interpreting the claims. The claims are intended to include all novel and non-obvious combinations and sub-combinations of the various elements, features, functions, and/or properties disclosed herein. Variations in size, materials, shape, form, function and manner of operation, assembly and use, are deemed readily apparent and obvious to one skilled in the art from this disclosure, and all equivalent relationships to those illustrated in the drawings and described in the specification are intended to be encompassed in the following claims defining the present invention.

The invention claimed is:

1. A universal hip pad set adapted to be selectively attached to athletic pants having either snap fasteners in the waistband, or to athletic pants having a waistband with a number of exposed belt slots through which a uniform belt extends, comprising:

a pair of hip pads, each formed of resilient flexible padding material having a front side and a back side, a first thin support plate affixed to said front side, and at least one second thin support plate affixed to said back side of each said hip pad, respectively, said first and said at least one second support plate each formed of a stiff material;

at least one pair of laterally spaced slotted apertures extending through each of said hip pads and said first and said at least one second support plates, respectively, each of said apertures having a vertical slot and an intersecting horizontal slot;

at least one pair of snap fastener members, each snap fastener member slidably mounted in a respective said horizontal slot and movable therein relative to said vertical slot between either of a first attachment position and a second attachment position;

in said first attachment position, said snap fastener members being movable to become aligned with mating snap members in the waistband of the athletic pants, and adapted to be pressed thereon to engage said snap fasteners of said pad with the mating fasteners of the waistband and secure said pads to the waistband of the pants; and in said second attachment position, said snap fastener members being movable to expose said vertical slots of said slotted apertures of said pads so as to be aligned with the exposed belt slots of the waistband of the athletic pants to allow lacing of the pants belt through said vertical slots of said apertures of said pads and secure said pads to the waistband of the pants.

2. The universal hip pad set according to claim 1, wherein each said hip pad is integrally molded and has a mid portion configured to cover and protect an iliac crest of a wearer's pelvis, a contiguous upper portion extending above said mid portion configured to cover and protect an area of the wearer's body above the iliac crest, and a contiguous lower portion configured to cover and protect a greater trochanter of the wearer's femur.

3. The universal hip pad set according to claim 2, wherein said hip pad upper portion is a flat generally rectangular configuration with rounded top corners, said mid portion is a flat generally elliptical configuration adjoined to a lower end of said upper portion, and said lower portion is a flat generally elliptical configuration adjoined to a lower end of said mid portion.

4. The universal hip pad set according to claim 3, wherein said contiguous generally elliptical mid portion is of greater width than said upper portion, and said generally elliptical lower portion is of smaller width than said mid portion.

5. The universal hip pad set according to claim 3, further comprising:

a smaller generally elliptical raised surface on the front side of said generally elliptical lower portion to increase the thickness of said lower portion.

6. The universal hip pad set according to claim 2, further comprising:

a first recessed transverse groove at the juncture of said upper portion and said mid portion, and a second recessed transverse groove at the juncture of said lower portion and said mid portion, said transverse grooves facilitating flexure of said upper portion, said mid portion, and said lower portion relative to one another.

7. The universal hip pad set according to claim 1, further comprising:

a tailbone pad formed of resilient flexible padding material having a front side and a back side, a first thin support plate affixed to said front side of said tailbone pad, and a second thin support plate affixed to said back side of said tailbone pad, respectively, said first and said second support plate each formed of a stiff material;

at least one pair of laterally spaced slotted apertures extending through said tailbone pad and said first and second support plates, respectively, each of said apertures having a vertical slot and an intersecting horizontal slot;

at least one pair of snap fastener members, each snap fastener member slidably mounted in a respective said horizontal slot and movable therein relative to said vertical slot between either of a first attachment position and a second attachment position;

in said first attachment position, said snap fastener members being movable to become aligned with mating snap members in the waistband of the athletic pants, and adapted to be pressed thereon to engage said snap fasteners of said tailbone pad with the mating fasteners of the waistband and secure said tailbone pad to the waistband of the pants; and in said second attachment position, said snap fastener members being movable to expose said vertical slots of said slotted apertures of said tailbone pad so as to be aligned with the exposed belt slots of the waistband of the athletic pants to allow lacing of the pants belt through said vertical slots of said apertures of said tailbone pad and secure said tailbone pad to the waistband of the pants.

8. The universal hip pad set according to claim 7, wherein said tailbone pad is a generally rectangular configuration having a wider upper portion that converges downwardly and adjoins a contiguous lower portion of a narrower width, and rounded corners.

9. A universal hip pad adapted to be selectively attached to athletic pants having either snap fasteners in the waistband, or to athletic pants having a waistband with a number of exposed belt slots through which a uniform belt extends, comprising:

a hip pad formed of resilient flexible padding material having a front side and a back side, a first thin support plate affixed to said front side of said pad, and at least one second thin support plate affixed to said back side of said hip pad, respectively, said first and said at least one second support plate each formed of a stiff material;

at least one pair of laterally spaced slotted apertures extending through said hip pad and said first and said at least one second support plates, respectively, each of said apertures having a vertical slot and an intersecting horizontal slot;

at least one pair of snap fastener members, each snap fastener member slidably mounted in a respective said horizontal slot and movable therein relative to said vertical slot between either of a first attachment position and a second attachment position;

in said first attachment position, said snap fastener members being movable to become aligned with mating snap members in the waistband of the athletic pants, and adapted to be pressed thereon to engage said snap fasteners of said pad with the mating fasteners of the waistband and secure said pad to the waistband of the pants; and in said second attachment position, said snap fastener members being movable to expose said vertical slots of said slotted apertures of said pads so as to be aligned with the exposed belt slots of the waistband of the athletic pants to allow lacing of the pants belt through said vertical slots of said apertures of said pad and secure said pad to the waistband of the pants.

10. The universal hip pad according to claim 9, wherein said hip pad is integrally molded and has a mid portion configured to cover and protect an iliac crest of a wearer's pelvis, a contiguous upper portion extending above said mid portion configured to cover and protect an area of the wearer's body above the iliac crest, and a contiguous lower portion configured to cover and protect a greater trochanter of the wearer's femur.

11. The universal hip pad according to claim 10, wherein said hip pad upper portion is a flat generally rectangular configuration with rounded top corners, said mid portion is a flat generally elliptical configuration adjoined to a lower end of said upper portion, and said lower portion is a flat generally elliptical configuration adjoined to a lower end of said mid portion.

12. The universal hip pad according to claim 11, wherein said contiguous generally elliptical mid portion is of greater width than said upper portion, and said generally elliptical lower portion is of smaller width than said mid portion.

13. The universal hip pad according to claim 11, further comprising:

a smaller generally elliptical raised surface on the front side of said generally elliptical lower portion to increase the thickness of said lower portion.

14. The universal hip pad according to claim 10, further comprising:

a first recessed transverse groove at the juncture of said upper portion and said mid portion, and a second recessed transverse groove at the juncture of said lower portion and said mid portion, said transverse grooves facilitating flexure of said upper portion, said mid portion, and said lower portion relative to one another.

15. A universal tailbone pad adapted to be selectively attached to athletic pants having either snap fasteners in the waistband, or to athletic pants having a waistband with a number of exposed belt slots through which a uniform belt extends, comprising:

a tailbone pad formed of resilient flexible padding material having a front side and a back side, a first thin support plate affixed to said front side of said tailbone pad, and a second thin support plate affixed to said back side of said tailbone pad, respectively, said first and said second support plate each formed of a stiff material;

at least one pair of laterally spaced slotted apertures extending through said tailbone pad and said first and second support plates, respectively, each of said apertures having a vertical slot and an intersecting horizontal slot;

at least one pair of snap fastener members, each snap fastener member slidably mounted in a respective said horizontal slot and movable therein relative to said vertical slot between either of a first attachment position and a second attachment position;

in said first attachment position, said snap fastener members being movable to become aligned with mating snap members in the waistband of the athletic pants, and adapted to be pressed thereon to engage said snap fasteners of said tailbone pad with the mating fasteners of the waistband and secure said tailbone pad to the waistband of the pants; and in said second attachment position, said snap fastener members being movable to expose said vertical slots of said slotted apertures of said tailbone pad so as to be aligned with the exposed belt slots of the waistband of the athletic pants to allow lacing of the pants belt through said vertical slots of said apertures of said tailbone pad and secure said tailbone pad to the waistband of the pants.

16. The universal tailbone pad according to claim 15, wherein said tailbone pad is a generally rectangular configuration with rounded corners having a wider upper portion that converges downwardly and adjoins a contiguous lower portion of a narrower width.

* * * * *